US008661610B2

(12) United States Patent
Liu et al.

(10) Patent No.: US 8,661,610 B2
(45) Date of Patent: Mar. 4, 2014

(54) INTEGRATED BAG DOOR AND CARRY HANDLE FOR A FLOOR CLEANER

(75) Inventors: Andrew Q. Liu, Twinsburg, OH (US); Mark E. Cipolla, Chardon, OH (US); Steven R. Dings, Mentor, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 346 days.

(21) Appl. No.: 13/046,483

(22) Filed: Mar. 11, 2011

(65) Prior Publication Data

US 2011/0219582 A1 Sep. 15, 2011

Related U.S. Application Data

(60) Provisional application No. 61/313,414, filed on Mar. 12, 2010.

(51) Int. Cl.
*A47L 5/28* (2006.01)

(52) U.S. Cl.
USPC ..... 15/351; 15/410

(58) Field of Classification Search
USPC ..... 15/347, 350, 351, 410
IPC ..... A47L 5/28
See application file for complete search history.

(56) References Cited

U.S. PATENT DOCUMENTS

| | | | |
|---|---|---|---|
| 3,816,983 | A | 6/1974 | Sawada et al. |
| 4,426,211 | A | 1/1984 | Ataka et al. |
| 6,256,834 | B1 | 7/2001 | Meijer et al. |
| 6,502,277 | B1 | 1/2003 | Petersson et al. |
| 6,859,975 | B2 | 3/2005 | Ohta et al. |
| 7,185,394 | B2 | 3/2007 | Hafling et al. |
| 7,267,704 | B2 | 9/2007 | Allgeier |
| 7,325,274 | B2 | 2/2008 | Jeong |
| 7,341,611 | B2 | 3/2008 | Greene et al. |
| 2003/0208878 | A1 | 11/2003 | Alford et al. |
| 2007/0084165 | A1 | 4/2007 | Nakai et al. |
| 2007/0209147 | A1 | 9/2007 | Krebs et al. |

FOREIGN PATENT DOCUMENTS

| | | |
|---|---|---|
| EP | 2229855 | 9/2010 |
| GB | 2407257 | 4/2005 |
| WO | 9720492 | 6/1997 |

OTHER PUBLICATIONS

International Search Report and Written Opinion for International Appl. No. PCT/US2011/028173 dated Jun. 24, 2011, 12 pages.
GB1216011.5 Examination Report dated Nov. 28, 2013 (4 pages).

*Primary Examiner* — David Redding
(74) *Attorney, Agent, or Firm* — Michael Best & Friedrich LLP

(57) ABSTRACT

A floor cleaner including a nozzle and a handle assembly pivotably mounted to the nozzle. The handle assembly including a handle, a motor housing supporting a suction source in fluid communication with the nozzle, and a bag housing. A door is removably coupled to the bag housing and includes a door handle and a filter bag retaining structure.

19 Claims, 7 Drawing Sheets

INTEGRATED BAG DOOR AND CARRY HANDLE FOR A FLOOR CLEANER

RELATED APPLICATIONS

This patent application claims priority to U.S. Provisional Patent Application No. 61/313,414 filed Mar. 12, 2010, the contents of which are hereby incorporated by reference in their entirety herein.

BACKGROUND

The present invention relates to floor cleaners. Specifically, the present invention relates to floor cleaners that utilize a filter bag, and structures for retaining the filter bag.

Typical upright floor cleaners include a suction source and a nozzle. Filter bags are commonly used to filter air drawn through the nozzle by the suction source to trap debris and dust. A filter bag door may be used to access the filter bag so that the filled bag can be removed and replaced with an empty bag within the bag housing.

SUMMARY

In one embodiment, the invention provides a floor cleaner that includes a nozzle and a handle assembly that is pivotably mounted to the nozzle. The handle assembly includes a handle, a motor housing that supports a suction source in fluid communication with the nozzle, and a bag housing. A door is removably coupled to the bag housing and includes a door handle and a filter bag retaining structure.

In another embodiment, the invention provides a floor cleaner that includes a nozzle and a handle assembly pivotably mounted to the nozzle. The handle assembly includes a handle, a latch structure, a motor housing that supports a suction source in fluid communication with the nozzle, and a bag housing that defines a dust cavity. The floor cleaner further includes a door that is removably coupled to the handle assembly and at least partially encloses the dust cavity. The door includes a door handle and a latch that is movable between a first position and a second position. The latch is configured to engage the latch structure when in the first position and to disengage the latch structure when in the second position. The floor cleaner is configured to be lifted by the door handle.

In another embodiment, the invention provides a floor cleaner including a nozzle, a handle assembly that is pivotably mounted to the nozzle and includes a handle, a motor housing that supports a suction source in fluid communication with the nozzle, and a bag housing defining a dust cavity. The floor cleaner also includes a door that is removably coupled to the handle assembly to at least partially enclose the dust cavity. The door includes a door handle. A closure assembly is connected to the door handle and is movable between a first position and a second position. The closure assembly includes a push button, a catch for engaging the handle assembly, a body that connects the push button and the catch, and a spring that biases the catch toward the first position. The door is inhibited from removal from the handle assembly when the closure assembly is in the first position and the door is free to be removed from the handle assembly when the closure assembly is in the second position. The floor cleaner is configured to be lifted by the door handle.

Other aspects of the invention will become apparent by consideration of the Detailed Description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. In the following description, "up" refers to a direction perpendicular to a floor and extending vertically away from the floor, and "down" refers to a direction opposite "up" and toward the floor. Likewise, "top" refers to a location above, or in a direction vertically down with respect to a reference and "bottom" refers to a location below, or in a direction vertically down with respect to a reference. Similar references and descriptions will be obvious to a reasonable observer. For example, an object near the bottom of a body 118 is closer to the bottom of the body 118 than the top.

Figure 1:
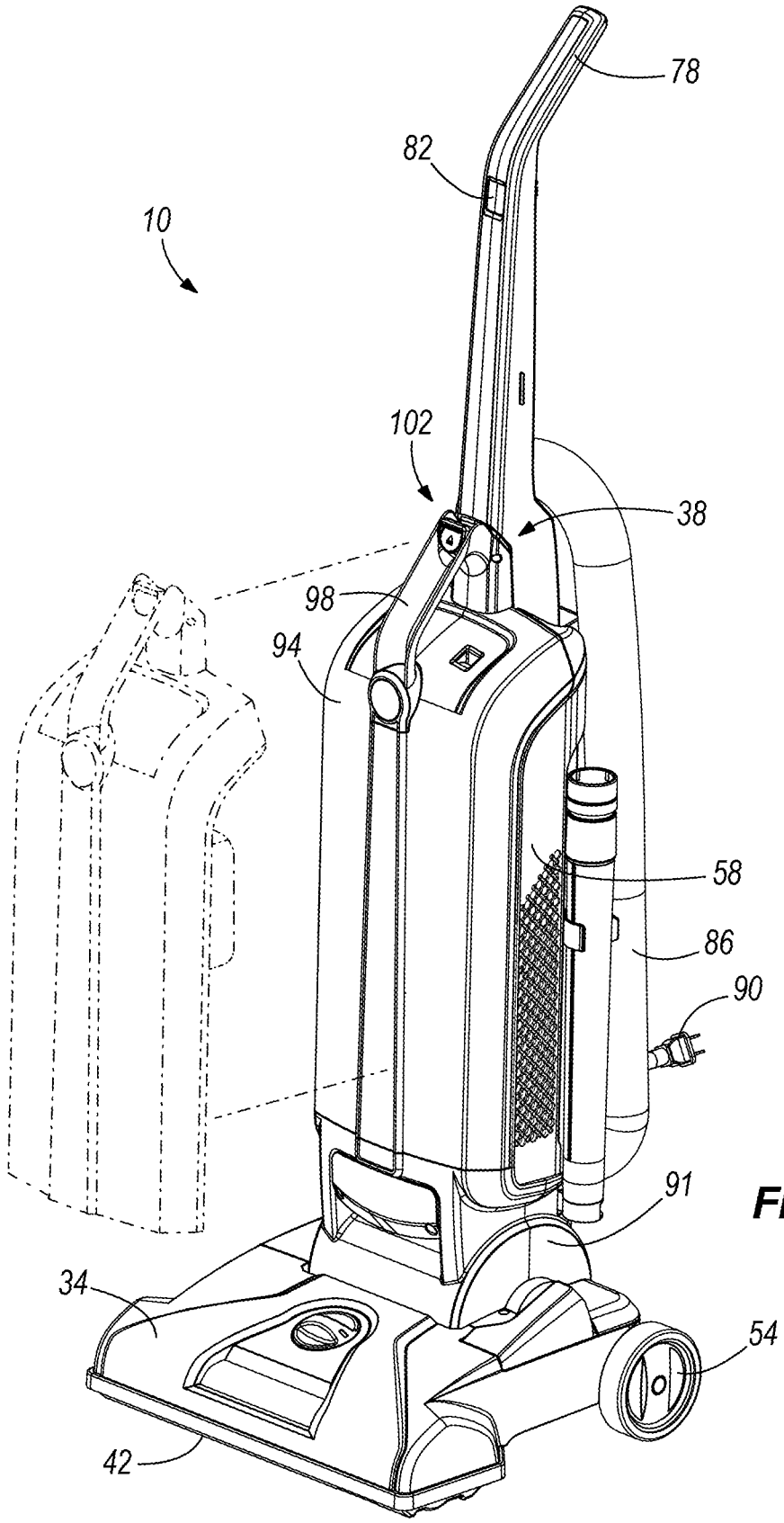
FIG. 1 is a perspective view of a floor cleaner incorporating the present invention.
Figure 9:
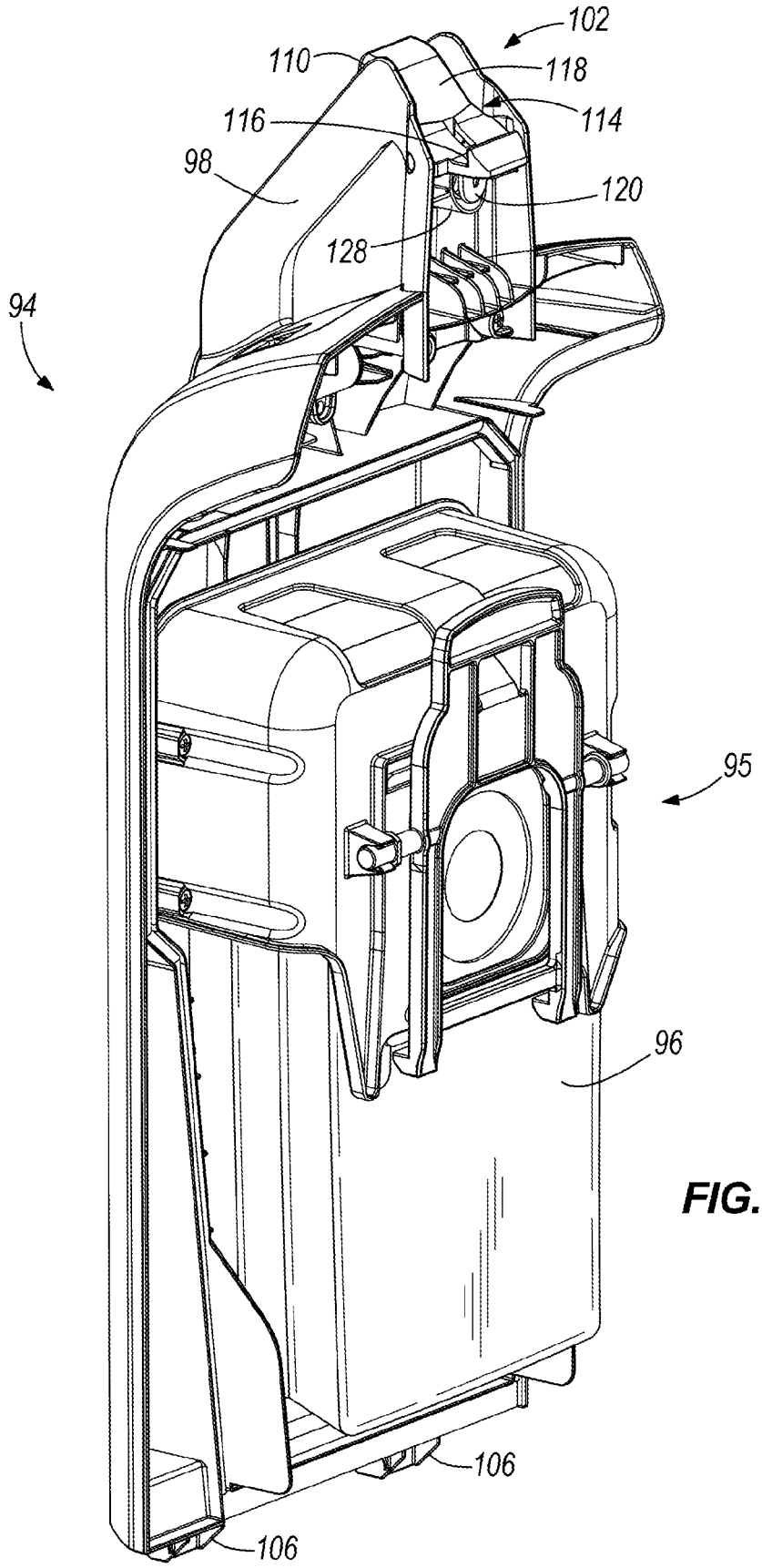
FIG. 9 is a perspective view of the door of FIG. 2, showing a filter bag attached to the door.

FIG. 1 shows a floor cleaner 10 or a vacuum cleaner that utilizes a filter bag (FIG. 9). The floor cleaner 10 includes a base portion 34 and a handle assembly 38 that rotates relative to the base portion 34. The base portion 34 includes a nozzle 42. Sets of opposed wheels 54 (only one wheel being shown) are rotatably connected to the base portion 34 such that the floor cleaner 10 can move across the floor.

The handle assembly 38 includes a dust cavity 58, a cleaner handle 78, vacuum controls 82, an extension tube 86, a power cord 90, and a motor housing 91 that supports a fan (not shown) or suction source driven by a motor (not shown). The motor selectively rotates the fan to create a suction at the nozzle 42 such that debris and dust are sucked into the nozzle 42 along with air. Alternatively, the suction source or other components may be located in another part of the floor cleaner 10. The physical layout and particular design of the floor cleaner 10 does not limit the scope of the invention. For example, many cosmetic changes may be made to the illustrated upright floor cleaner 10. Further, the floor cleaner 10 may include other features not mentioned herein. Further details about floor cleaners, and vacuums in particular, may be found in U.S. Patent Publication No. 2008/0271285 published Nov. 6, 2008, assigned to the same Assignee as the present invention, the contents of which are incorporated by reference herein.

Figure 2:
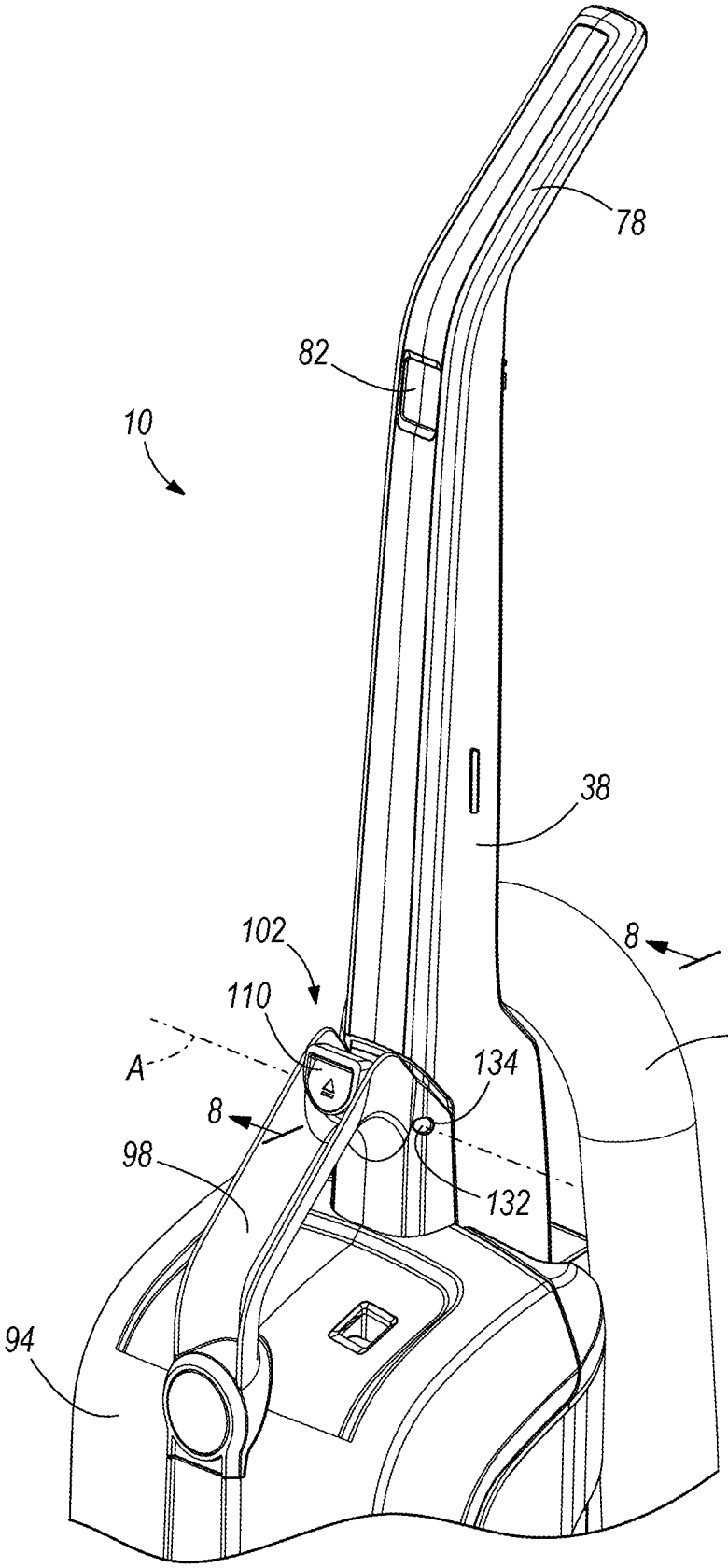
FIG. 2 is a perspective view of a door assembled with the floor cleaner of FIG. 1.
Figure 3:
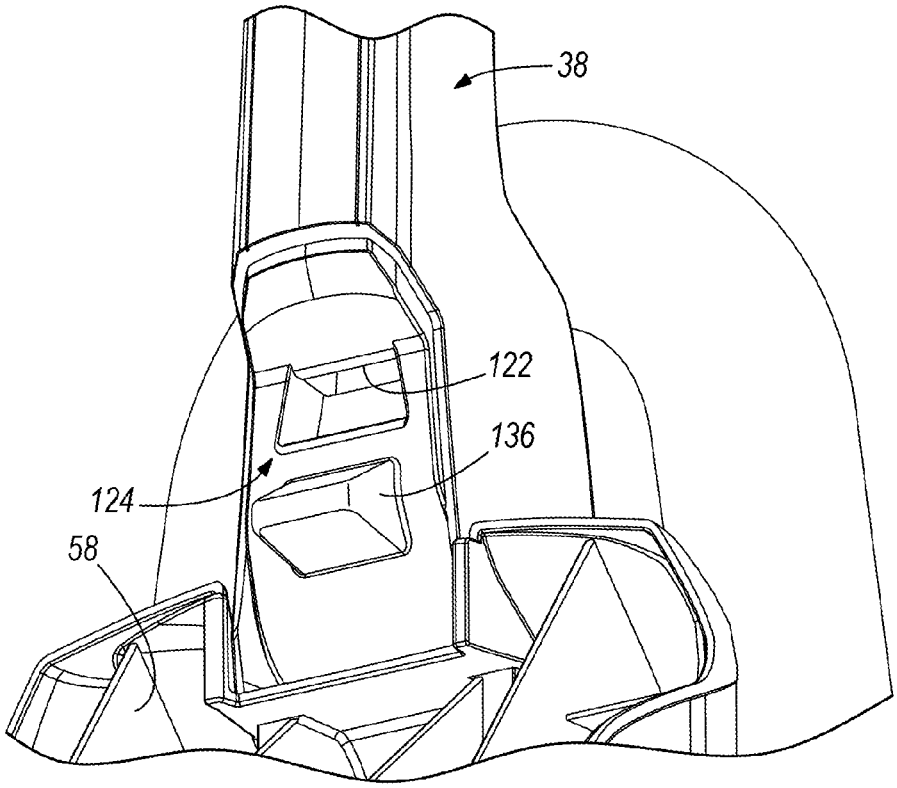
FIG. 3 is a perspective view the floor cleaner of FIG. 1 with the door removed.

With reference to FIG. 2, a door 94 is removably coupled to the handle assembly 38 to cover the dust cavity 58, and is movable between an installed or a closed position (shown in solid lines in FIG. 1) and a removed or an open position (shown in broken lines in FIG. 1). With reference to FIG. 9, the door 94 includes a filter bag retaining structure 95 that holds the filter bag 96 during operation of the floor cleaner 10, and when the door 94 is in the open position and the closed position. In the illustrated construction, the door 94 covers, and substantially encloses the dust cavity 58 when in the closed position, and is removed from the handle assembly 38 when in the open position. In other constructions, the door 94 may cover or enclose a portion of the dust cavity 58 when in the closed position. For example, the handle assembly 38 may enclose a portion of the dust cavity 58 or a portion of the dust cavity 58 may be uncovered. The door 94 includes a door handle 98, a closure assembly 102, and closure members 106 (see FIG. 9).

Figure 4:
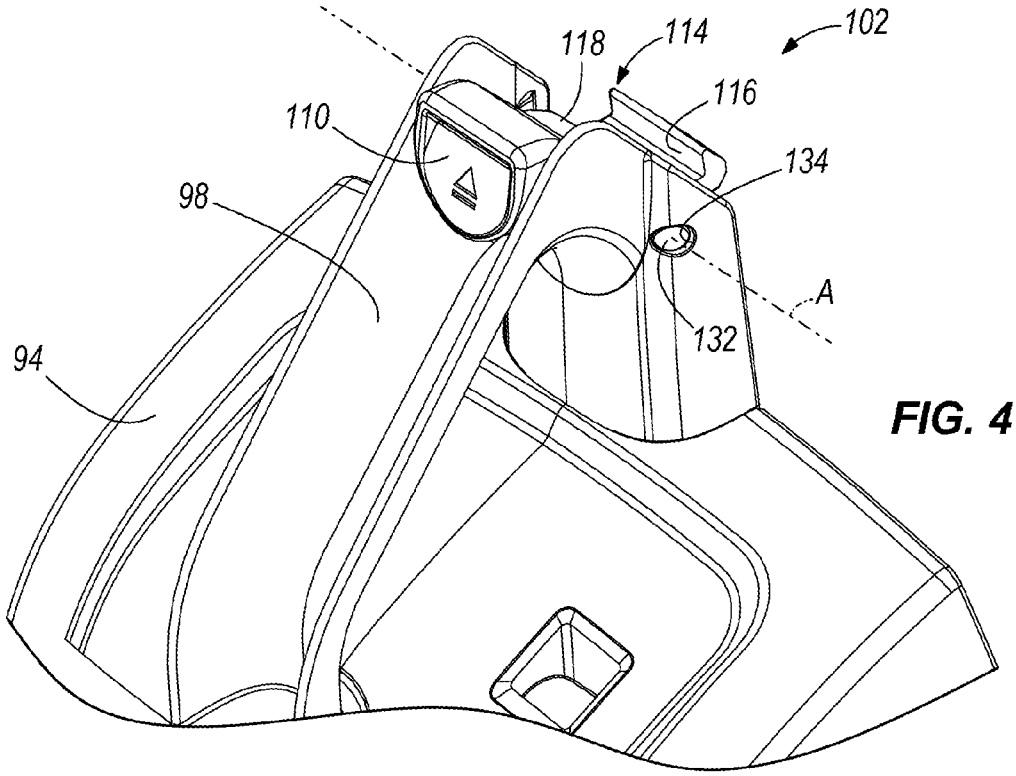
FIG. 4 is a close-up view of a portion of the door of FIG. 2.
Figure 5:
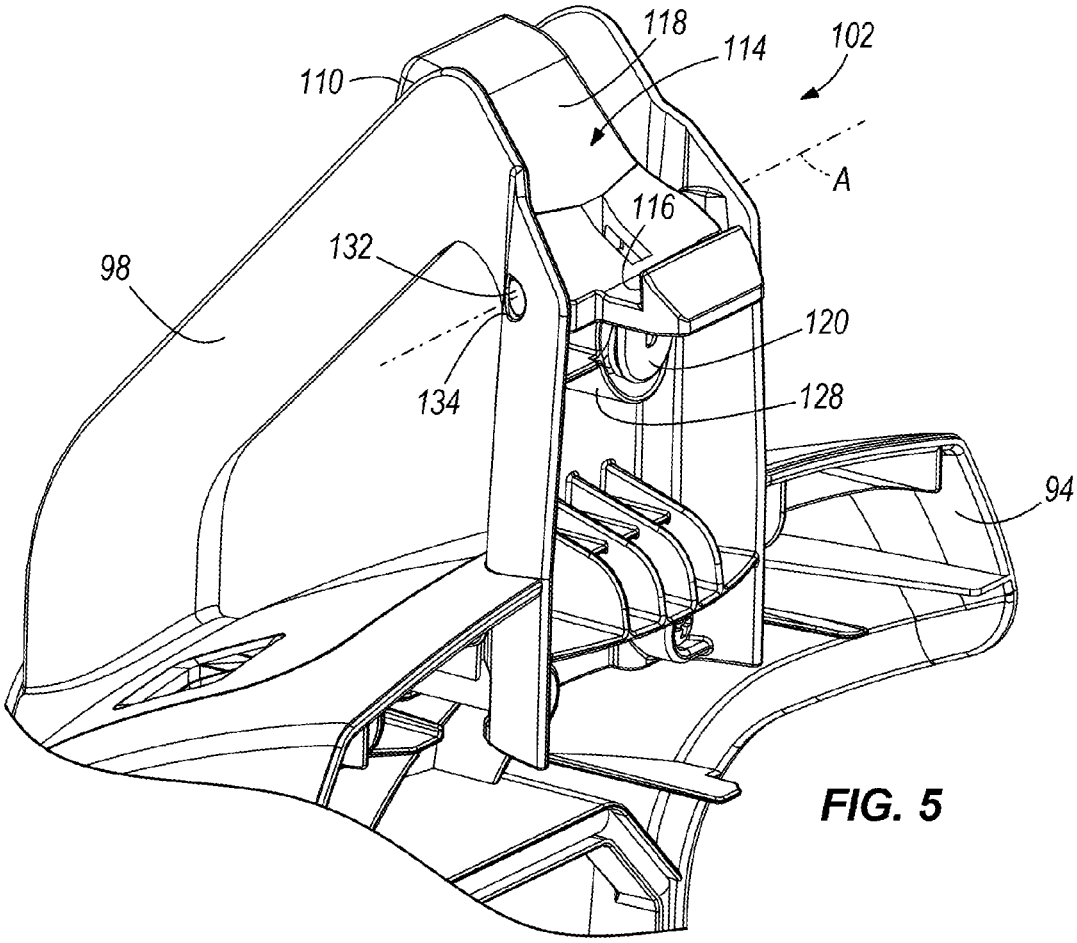
FIG. 5 is another close-up view of a portion of the door of FIG. 2.
Figure 7:
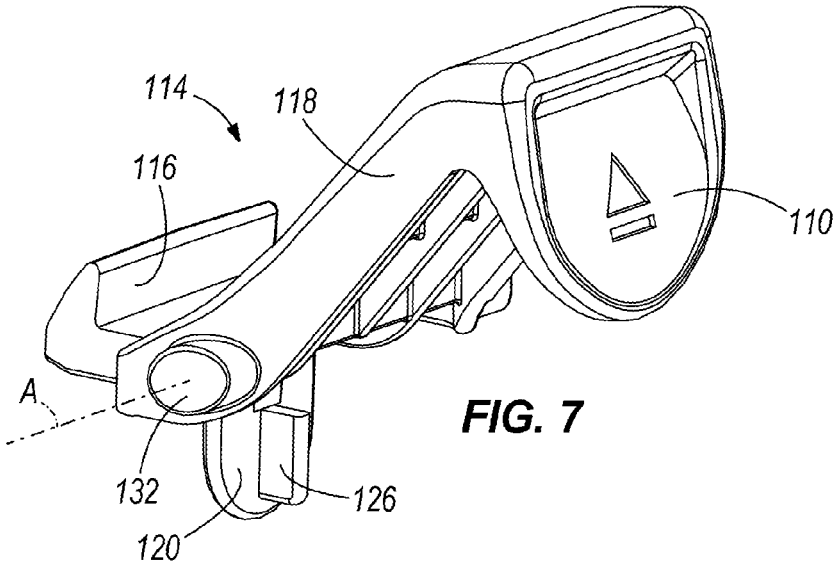
FIG. 7 is a perspective view of a latch of the door of FIG. 2.
Figure 6:
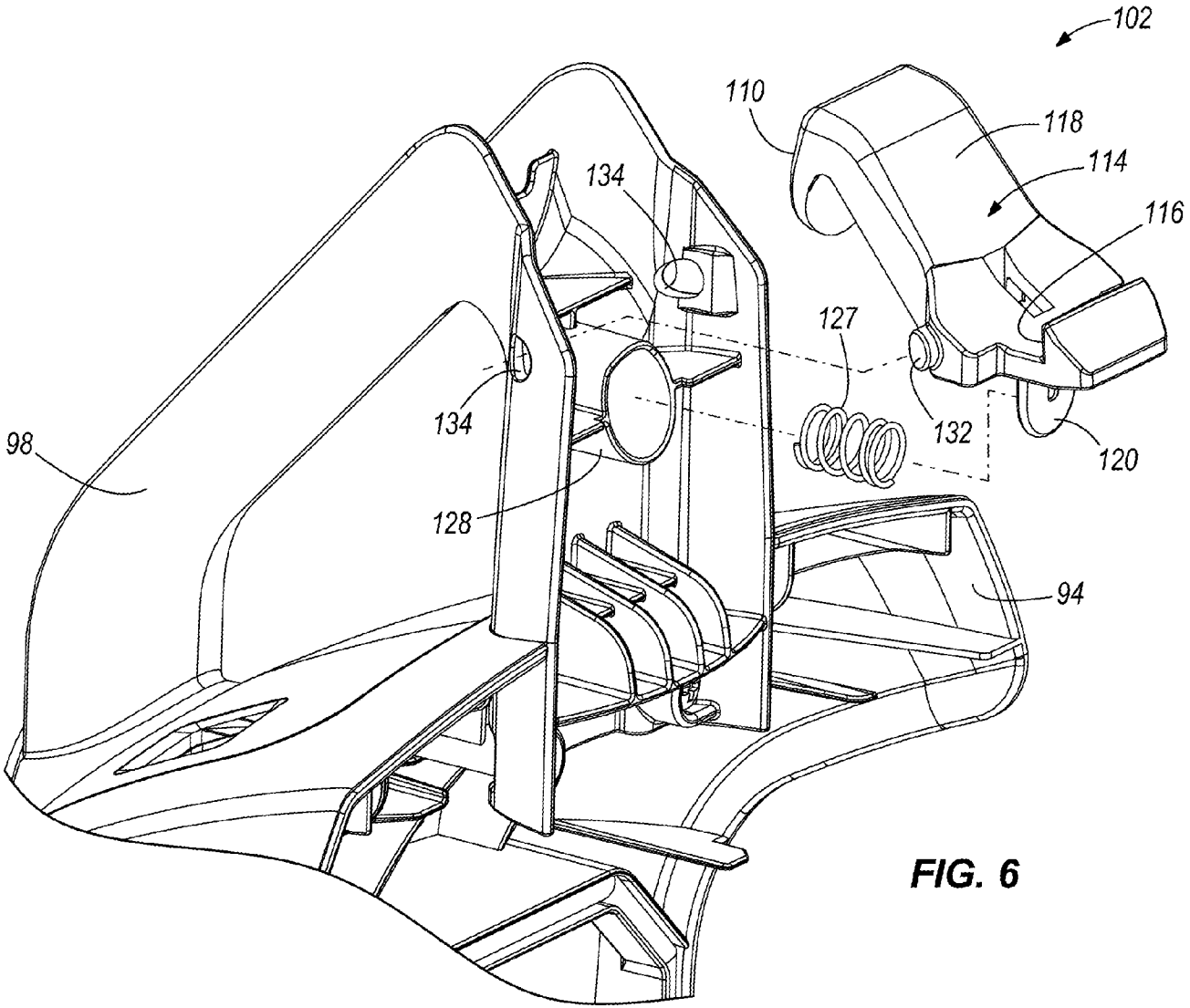
FIG. 6 is an exploded view of the door portion of FIG. 5.
Figure 8:
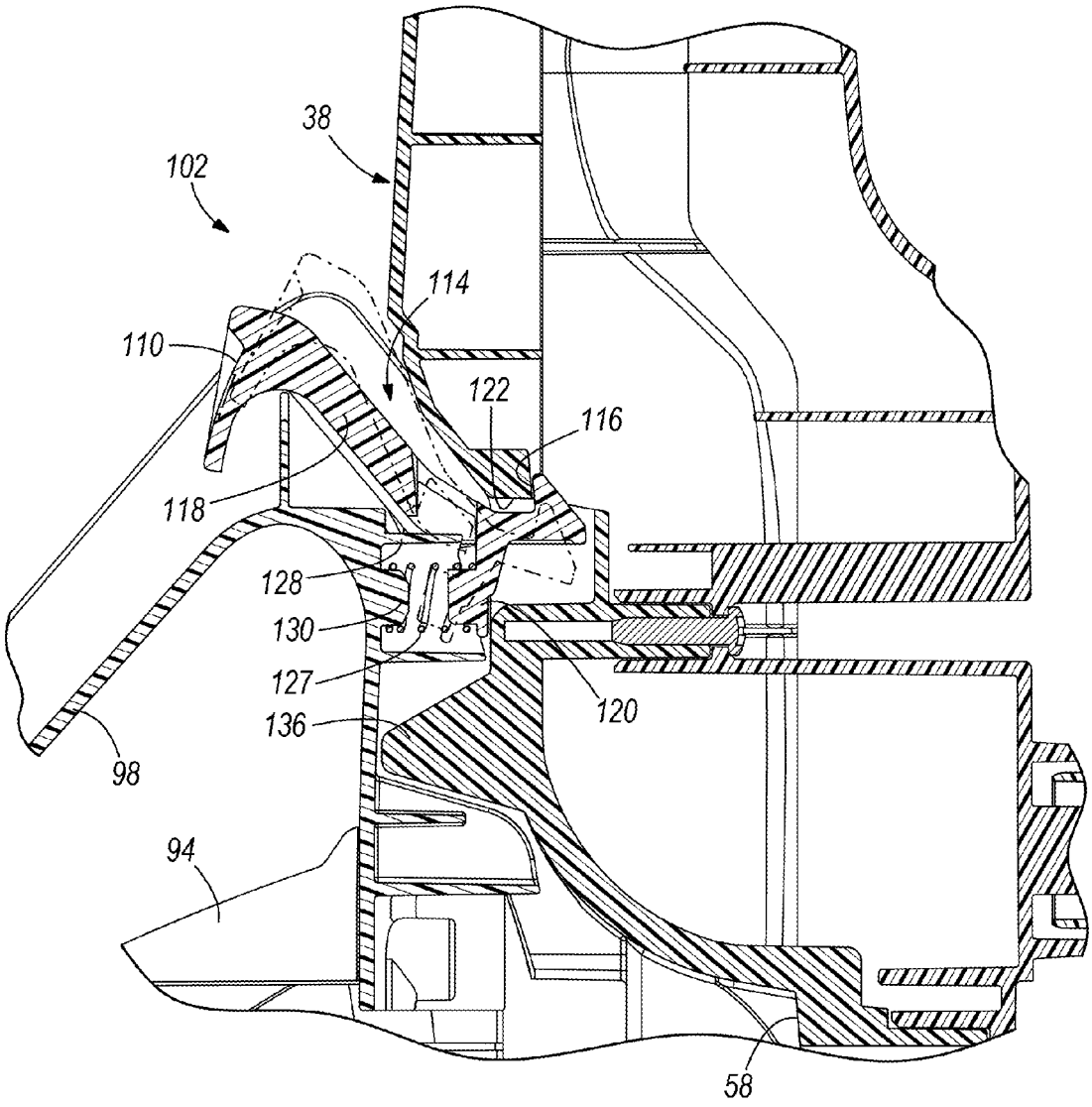
FIG. 8 is a section view of the door assembled with the floor cleaner taken along line 8-8 of FIG. 2.

With reference to FIGS. 4 and 5, the illustrated closure assembly 102 is positioned on the door handle 98 and includes a push button 110 and a latch 114. In the illustrated construction, the push button 110 and the latch 114 are formed as a single piece. The latch 114 includes a projection or catch 116, a body 118 that extends between the catch 116 and the push button 110, and a spring member 120. The catch 116 is sized and shaped to be received within a catch recess 122 of a latch structure 124 formed in the handle assembly 38. The body 118 translates movement of the push button 110 to the catch 116. The spring member 120 includes a projection 126 and a spring 127 is sized to engage the projection 126. The door handle 98 includes a door spring member 128 with a projection 130 sized to engage the spring 127 such that the spring 127 is engaged between the door handle 98 and the latch 114 (see FIG. 8).

The latch 114 also includes pivot structure that defines an axis A. The illustrated pivot structure includes two pins 132 disposed on opposite sides of the latch 114. The door handle 98 includes door pivot structure in the form of apertures 134 sized to receive the pins 132. The latch 114 is rotatable about the axis A between a first position (shown in solid lines in FIG. 8) and a second position (shown in broken lines in FIG. 8) in response to movement of the push button 110.

When the door 94 is in the closed position, the latch 114 is biased toward the first position by the spring 127 and the catch 116 engages the catch recess 122 (see FIG. 8) on the handle assembly 38 to maintain the door 94 in the closed position. The latch 114 rotates with respect to the door handle 98 from the first position to the second position when the push button 110 is pushed such that the catch 116 releases the catch recess 122 and the door 94 may be moved from the closed position to the open position. The illustrated catch 116 is shaped such that the catch 116 will rotate from the first position to the second position upon being pressed against the catch recess 122 when moving the door 94 from the open position to the closed position. In this way, the door 94 snaps into position from the open position to the closed position. In other constructions, the closure assembly 102 may be arranged differently to maintain the door 94 in the closed position, as desired.

The closure members 106 cooperate with the closure assembly 102 to maintain the door 94 in the closed position. The illustrated closure members 106 extend from the bottom of the door 94 and engage corresponding closure structure in the handle assembly 38 to fix the bottom of the door 94 to the handle assembly 38. The closure structure includes recesses sized to receive the closure members 106. In other constructions, the closure members 106 may be recesses and the closure structure may be projections that extend from the handle assembly 38. Likewise another form of engagement may be used to selectively fix the bottom of the door 94 to the handle assembly 38.

The door 94 and the handle assembly 38 include further features to stabilize the door 94 when in the closed position. For example, a projection 136 is received in the door 94 and helps stabilize the structure. Other stabilizing features could be used.

In operation, with the door 94 installed on the handle assembly 38 in the closed position, a user grasps the door 94 by the door handle 98 and depresses the push button 110. The latch 114 is moved from the first position to the second position and releases the latch structure 124 of the handle assembly 38. The user then rotates the door 94 away from the handle assembly 38 about the closure members 106. When the door 94 is substantially disengaged from the handle assembly 38, the door 94 is lifted such that the closure members 106 disengage the closure structure of the handle assembly 38 and the door 94 is disconnected from the handle assembly 38 and in the open position.

To move the door 94 from the open position to the closed position, the user engages the closure members 106 with the closure structure by inserting the projecting closure members 106 into the recesses of the closure structure. The door 94 is then rotated toward the handle assembly 38 until the latch 114 contacts the latch structure 124 of the handle assembly 38. The door 94 is then pressed toward the handle assembly 38 such that the latch 114 is moved, via its shape, from the first position to the second position. The latch 114 then snaps over and engages the latch structure 124 to secure the door 94 in the closed position. Alternatively, the user may depress the push button 110 to move the latch 114 to the second position before moving the door 94 from the open position to the closed position, then release the push button 110 to allow the spring to move latch 114 to the first position.

When the door 94 is in the closed position, the door handle 98 is used to lift and move the floor cleaner 10. When the door 94 is in the open position, the door handle 98 is used to lift and move the door 94. In other constructions, the door handle 98 may be a different shape or positioned differently, as desired.

In an alternative construction, the closure assembly 102 does not rotate but translates to move between the first and second positions. Several latching structures may be employed to couple the door 94 to the handle assembly 38.

Thus, the invention provides a floor cleaner that allows a user to carry the floor cleaner with a handle and also use that handle to carry a door. The carry/door handle and the door may be formed as a single piece. The door may include mounting structure for holding the Various features and advantages of the invention are set forth in the following claims.

What is claimed is:

1. A floor cleaner comprising:

a nozzle;

a handle assembly pivotably mounted to the nozzle, the handle assembly including a handle, a motor housing supporting a suction source in fluid communication with the nozzle, and a bag housing; and a door removably coupled to the bag housing, the door including a door handle and a filter bag retaining structure, wherein the floor cleaner is configured to be lifted by the door handle.

2. The floor cleaner of claim 1, wherein the door is movable between a first position where the door is coupled to the bag housing, and a second position where the door is removed from the bag housing.

3. The floor cleaner of claim 2, the filter bag retaining structure configured to hold a filter bag in the first position and in the second position.

4. The floor cleaner of claim 2, wherein the floor cleaner is configured to be lifted by the door handle when the door is in the first position.

5. The floor cleaner of claim 1, wherein the handle assembly includes a projection that engages the door handle to stabilize the door.

6. The floor cleaner of claim 1, wherein the housing assembly includes a latch structure, and wherein the door includes a latch movable between in a first position and a second position, the latch co figured to engage the latch structure when in the first position and to disengage the latch structure when in the second position.

7. The floor cleaner of claim 1, further comprising a closure assembly connected to the door handle and movable between a first position and a second position, the closure assembly including a push button, a catch for engaging the handle assembly, a body connecting the push button and the catch, and a spring biasing the catch toward the first position;

wherein the door is inhibited from removal from the bag housing when the closure assembly is in the first position and the door is free to be removed from the bag housing when the closure assembly is in the second position.

8. The floor cleaner of claim 1, wherein the bag housing defines a dust cavity, and the door at least partially enclosing the dust cavity.

9. A floor cleaner comprising:

a nozzle;

a handle assembly pivotably mounted to the nozzle, the handle assembly including a handle, a latch structure, a motor housing supporting a suction source in fluid communication with the nozzle, and a bag housing defining a dust cavity; and a door removably coupled to the handle assembly and at least partially enclosing the dust cavity, the door including a door handle and a latch movable between a first position and a second position, the latch configured to engage the latch structure when in the first position and to disengage the latch structure when in the second position, the floor cleaner configured to be lifted by the door handle.

10. The floor cleaner of claim 9, wherein the door is movable between a closed position where the door is coupled to the handle assembly, and an open position where the door is removed from the handle assembly.

11. The floor cleaner of claim 10, wherein the door includes a filter bag retaining structure configured to hold a filter bag in the closed position and in the open position.

12. The floor cleaner of claim 9, wherein the latch rotates between the first position and the second position.

13. The floor cleaner of claim 12, wherein the latch is rotatably coupled to the door about an axis.

14. The floor cleaner of claim 9, wherein one of the door handle and the handle assembly includes a cavity, and the other of the door handle and the handle assembly includes a projection, the projection received within the cavity when the latch is engaged with the latch structure to stabilize the door.

15. A floor cleaner comprising:

a nozzle;

a handle assembly pivotably mounted to the nozzle, the handle assembly including a handle, a motor housing supporting a suction source in fluid communication with the nozzle, and a bag housing defining a dust cavity; and a door removably coupled to the handle assembly to at least partially enclose the dust cavity, the door including a door handle; and a closure assembly connected to the door handle and movable between a first position and a second position, the closure assembly including a push button, a catch for engaging the handle assembly, a body connecting the push button and the catch, and a spring biasing the catch toward the first position, wherein the door is inhibited from removal from the handle assembly when the closure assembly is in the first position and the door is free to be removed from the handle assembly when the closure assembly is in the second position, and wherein the floor cleaner is configured to be lifted by the door handle.

16. The floor cleaner of claim 15, wherein the push button, the catch, and the body are formed as a single piece.

17. The floor cleaner of claim 16, wherein the push button, the catch, and the body rotate relative to the door handle between the first position and the second position.

18. The floor cleaner of claim 15, wherein the body includes pins that project from the body and are received in corresponding structure formed in the door handle to couple the body to the door handle.

19. The floor cleaner of claim 15, wherein the door is movable between a closed position where the door is coupled to the handle assembly, and an open position where the door is removed from the handle assembly; and wherein the door includes a filter bag retaining structure configured to hold a filter bag in the closed position and in the open position.

* * * * *